US006702031B2

(12) United States Patent
Doane et al.

(10) Patent No.: US 6,702,031 B2
(45) Date of Patent: Mar. 9, 2004

(54) ANCHORING DEVICE REMOVAL METHOD AND APPARATUS

(75) Inventors: James C. Doane, Friendswood, TX (US); Michael Vincent Smith, The Woodlands, TX (US); Roger Steele, Houston, TX (US); John P. Davis, Cypress, TX (US); David B. Haughton, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/061,947

(22) Filed: Jan. 31, 2002

(65) Prior Publication Data

US 2002/0144817 A1 Oct. 10, 2002

Related U.S. Application Data

(60) Provisional application No. 60/266,086, filed on Feb. 2, 2001.

(51) Int. Cl.[7] ..... E21B 23/01

(52) U.S. Cl. ..... 166/382; 166/55.7; 166/122; 166/123; 166/181; 166/187; 166/298

(58) Field of Search ..... 166/382, 383, 166/387, 120, 122, 123, 181, 187, 298, 55.7

(56) References Cited

U.S. PATENT DOCUMENTS

| | | | | |
|---|---|---|---|---|
| 2,746,550 A | | 5/1956 | Mitchell, Jr. | |
| 2,934,147 A | | 4/1960 | Baker | |
| 3,330,339 A | | 7/1967 | Johnson | |
| 4,413,677 A | | 11/1983 | Perkins | 166/55.1 |
| 5,117,906 A | | 6/1992 | Giusti, Jr. et al. | |
| 5,123,489 A | | 6/1992 | Davis et al. | |
| 5,720,343 A | | 2/1998 | Kilgore et al. | |
| 6,112,811 A | * | 9/2000 | Kilgore et al. | 166/134 |
| 6,478,093 B1 | * | 11/2002 | Hilts et al. | 166/387 |

OTHER PUBLICATIONS

Halliburton Energy Services, Inc.; AHC Hydraulic–Set Packer; Halliburton product advertisement and specification, 1999, 2 pages.

Halliburton; AHC Hydraulic–Set Packer; Product sheet and ordering information; date unknown; 1 page.

* cited by examiner

*Primary Examiner*—Zakiya Walker
(74) *Attorney, Agent, or Firm*—Gerald W. Spinks

(57) ABSTRACT

A method and apparatus for severing the mandrel of an anchor device such as a packer to release the packer and remove it from a well. A cutter locator profile above the packer assembly and a cutter locator element on the cutting tool are located so as to precisely position the cutting element at a desired location on the packer mandrel. Once the mandrel is severed, the packer assembly can elongate to release the expansion mechanism. Then, the packer assembly can be pulled upwardly to release the packer, and to remove it from the well. A cutting tool can be lowered through production tubing to sever the mandrel, followed by pulling the packer with the production tubing. Alternatively, a cutting tool can be lowered on a workstring and latched to the upper end of the packer assembly, followed by severing the mandrel and pulling the packer with the workstring.

27 Claims, 2 Drawing Sheets

ANCHORING DEVICE REMOVAL METHOD AND APPARATUS

CROSS REFERENCE TO RELATED APPLICATIONS

This application claims the benefit of U.S. Provisional Patent Application Ser. No. 60/266,086, filed Feb. 2, 2001, for "Anchoring Device Removal Method and Apparatus".

STATEMENT REGARDING FEDERALLY SPONSORED RESEARCH OR DEVELOPMENT

Not Applicable

BACKGROUND OF THE INVENTION

1. Field of the Invention

This invention is in the field of apparatus used to remove an anchoring device, such as a packer, from a well, when the anchoring device has been anchored in place between the production tubing and the casing.

2. Background Art

When an oil or gas well is drilled, it is common to insert a casing into the well bore to maintain the well bore and to provide numerous options for modifying the well bore and producing oil or gas from downhole formations. A production tube, usually composed of threaded steel tubular members, is then typically lowered into the casing to deliver fluids from the well. At various depths, one or more packer assemblies are often installed between the production tubing and the casing, to seal off the annular space between the production tubing and the casing. This allows production of oil or gas fluids from different formations at various depths, which are separated by these packer assemblies.

Packer assemblies usually have one or more elastomeric elements which are expanded radially outwardly, to forcefully contact the casing, to create a liquid tight seal between the production tubing and the casing. Further, packer assemblies usually have one or more slip assemblies which expand radially outwardly, to forcefully contact the casing, to mechanically hold the packer assembly in place relative to the casing. The slip assemblies are usually segmented metallic members with multiple teeth on their outwardly facing surfaces. The expansion mechanisms, including the elastomeric elements and the slip assemblies, are often expanded radially by the longitudinal movement of a setting mechanism, which often includes a hydraulically driven piston. The piston can act against a ramp contour, for example, to convert the longitudinal motion of the piston to the outward radial motion required to expand the expansion mechanisms.

Anchoring devices other than packer assemblies may have only slip assemblies and no sealing elements. Where the terms packer or packer assembly are used in this application, it should be understood that reference is also made to nonsealing types of anchoring devices, where the language permits.

Since the packer assembly is usually mechanically attached to the production tubing, such as by threaded connections, anchoring the packer in the casing also fixes the production tubing in place in the casing. Therefore, if it becomes necessary to remove the production tubing, it is necessary to remove the packer assemblies, either separately or along with the production tubing. It can also sometimes be desirable to release a packer assembly and leave it in place. It is common to provide a means of releasing a packer assembly, by adapting the setting mechanism to be released in some way, such as by relieving the hydraulic pressure on a piston to allow the piston to retract, or by forcefully retracting the piston. Others are designed to enable the releasing of the packer by rotation of an operating element, or by other means. A packer assembly which has been designed to release is often referred to as a "retrievable" packer, since it can be easily released and retrieved.

Other packer assemblies are not designed to be easily released, either for economic or operational reasons. That is, when the setting mechanism has been set, the packer will remain set, with no built-in provision for releasing the setting mechanism. This is sometimes accomplished by using detent mechanisms or other locking mechanisms to lock the setting mechanism in place. It would be desirable to have a method and apparatus for releasing and retrieving an anchoring device that may not have been designed as a retrievable device.

BRIEF SUMMARY OF THE INVENTION

The present invention includes a method and apparatus for releasing and retrieving from a well bore a packer assembly, or other anchoring device, which may otherwise be designed and implemented as a non-retrievable assembly. More specifically, the packer assembly is designed to expand and set its expansion mechanism by generating a longitudinal force which is converted into an outward radial force on the expansion mechanism. Once set, the setting mechanism is locked into place by a snap ring, detent mechanism, or some other locking mechanism.

A locator profile is included in the design and installation of the packer assembly, with the locator profile being utilized to precisely longitudinally locate a cutting tool which can later be lowered into the well, if it becomes necessary to release and retrieve the packer. A locator element is included in the design of the cutting tool, with the locator element being designed to land in, and in some cases latch into, the locator profile on the packer assembly. The cutting tool has either a cutting blade or another type of cutting element, such as a chemical cutter, laser, or torch. The distance between the locator element and the cutting element, on the cutting tool, is selected to precisely place the cutting element at a position where the body mandrel can be safely cut, once the cutter locator element has landed in the cutter locator profile.

Where the term body mandrel is used in this application, it should be understood that it is not intended to be limited to a specific type of member, except as the function of the body mandrel is described herein, relative to the operation of the packer assembly or other anchoring device.

The cutting element cuts through the body mandrel at the selected location. The depth of the cut is also precisely controlled to allow the cutting element to penetrate the body mandrel without penetrating the remainder of the packer assembly. This allows the ends of the packer assembly to move apart, to retract the setting mechanism, assisted if necessary by subsequent lifting on the packer assembly; it also allows the entire packer assembly and its tailpipe to be pulled from the well. A stop member is provided on the body mandrel for limiting the extent to which the anchor device can be pulled apart, to provide support for pulling the device out of the hole.

In one embodiment, the locator profile can include either an internal shoulder, or some other internal restriction, in a landing sub mounted to the production tubing. This shoulder can be located either above or below the packer. The cutting tool can include an external collar as a locator element, with the collar being designed to land on the shoulder for precise longitudinal positioning of the cutting element. In this embodiment, the upper end of the anchoring device or packer assembly is left attached to the production tubing. The cutting tool can be lowered through the production tubing, on either wireline or coil tubing, to cut through the body mandrel and release the packer. The packer can then be pulled out of the well, along with its tailpipe, by pulling the production tubing. In this embodiment, a chemical cutting element, torch, or laser can be lowered on either a wireline or coil tubing. A cutting tool having a blade can be lowered on coil tubing, with the blade being rotated by a downhole motor.

In another embodiment, the locator profile can be in a connector on the top of the packer assembly or anchoring device. This can be a removable seal bore, a threaded connector, or any other type of connector that may be present on the top of the anchoring device. The cutting tool can include a connector on its lower end, such as a latching mechanism, with the connector on the lower end of the cutting tool being designed to land on, and latch to, the connector on the upper end of the packer assembly, for precise longitudinal positioning of the cutting element. In this embodiment, the upper end of the packer assembly is first disconnected from the production tubing, and the production tubing above the packer is removed from the hole. The upper end of the packer assembly can then be prepared for connection to the cutting tool, if necessary, such as by removal of a seal bore. The cutting tool can be lowered through the casing, on a threaded tubular workstring, to land the connector on the lower end of the cutting tool in the connector on the upper end of the packer assembly. Once the cutting tool has been attached to the upper end of the packer assembly, the workstring can be rotated, if required to rotate the cutting element, to cut through the body mandrel and release the packer. The packer can then be pulled out of the well, along with its tailpipe, by pulling the workstring. In this embodiment, the cutting element can be either a blade, a chemical cutter, a torch, a laser, or some other type of cutting element. Similarly, as an alternative to rotating the workstring, a downhole motor can be used to rotate the blade or other cutting element.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
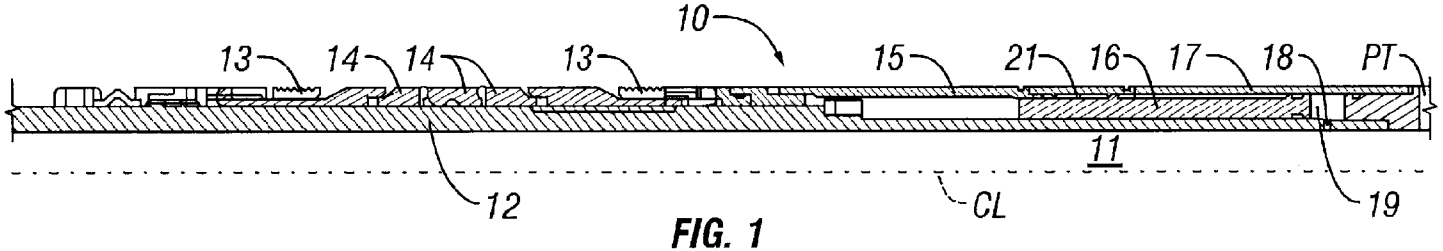
FIG. 1 is a longitudinal section view of a portion of a packer assembly according to the present invention, configured to be run into a casing on production tubing.
Figure 2:
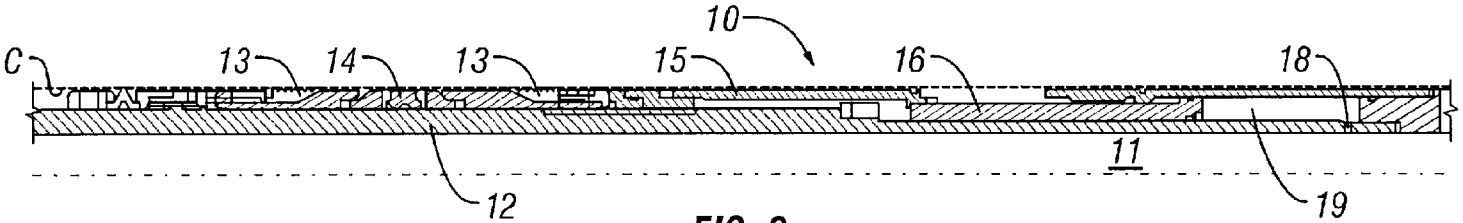
FIG. 2 is a longitudinal section view of the device shown in FIG. 1, configured to set within the casing.
Figure 3:
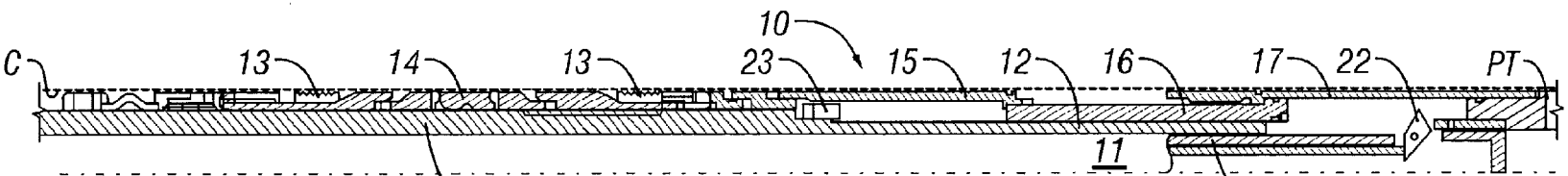
FIG. 3 is a longitudinal section view of the device shown in FIG. 1, showing the cutting blade cutting the body mandrel to release the expansion mechanism.

As shown in FIGS. 1 through 3, a packer assembly 10 according to the present invention can include a hollow cylindrical body mandrel 12, one or more expansion elements 13, 14 on an upper portion of the body mandrel 12, and a longitudinally movable annular piston 16 on a lower portion of the body mandrel 12. The packer assembly 10 is threaded, or otherwise attached, to production tubing PT at its lower end. The expansion mechanism can include one or more sets of segmented metallic slips 13, and their associated upper and lower ramps. The metallic slips 13 can have teeth or other gripping features on their outer surfaces. The expansion mechanism may or may not also include one or more sets of elastomeric annular sealing elements 14, and their associated upper and lower ramps. The upper end of the expansion mechanism is fastened to the body mandrel 12, by a stationary collar threaded to the body mandrel 12, or by some other fixed attachment means. One or more ramps can be associated with the stationary collar to interface with the upper ramps on the expansion mechanism.

The setting mechanism includes the annular piston 16, an annular piston cover 17, an annular piston sleeve 15, and one or more associated ramps. A snap ring 21 can also be provided between the annular piston 16 and the annular piston cover 17. Alternatively, a snap ring or other type of capture mechanism may be provided between the body mandrel 12 and the annular piston 16 or some other element of the setting mechanism. The lower end of the annular piston 16 is positioned in an annular cylinder 19 formed between the annular piston cover 17 and the lower portion of the body mandrel 12. The upper end of the annular piston 16 is attached to the lower end of the annular piston sleeve 15, and ultimately to its associated ramps next to the lower ramps of the expansion mechanism. An actuation port 18 is provided through the lower portion of the body mandrel 12, from the bore 11 of the body mandrel 12 to the annular cylinder 19.

FIG. 1 shows the packer assembly 10 in the configuration in which it is run into a casing in a well bore. The annular piston 16 is shown at the lower end of its travel, and the lower end of the annular piston sleeve 15 is shown latched to the upper end of the annular piston cover 17. Because of the lower position of the annular piston sleeve 15, its associated ramps are withdrawn from the lower ramps associated with the expansion elements 13, 14, and the expansion elements 13, 14 are therefore retracted or radially relaxed onto the body mandrel 12. In this condition, the body mandrel 12 supports the weight of the expansion mechanism, the setting mechanism, and the production tube PT, or tailpipe, attached to the lower end of the body mandrel 12.

FIG. 2 shows the packer assembly 10 in the configuration it assumes when it has been set against the casing C. Hydraulic pressure from a source at the well head (not shown) has been applied via the bore 11 of the body mandrel 12, and through the actuation port 18 to the annular cylinder 19. This hydraulic pressure has driven the annular piston 16 longitudinally upwardly, unlatching the annular piston sleeve 15 from the annular piston cover 17, and forcing the annular piston sleeve 15 upwardly. The annular piston sleeve 15 forces its associated ramps to interact with the lower ramps in the expansion mechanism, and forcing the expansion elements 13, 14 against the stationary collar above the expansion elements 13, 14. It can be seen that the reactive force from the expansion elements 13, 14 places the annular piston 16 and the annular piston sleeve 15 in compression, and the body mandrel 12 in tension. The interactions between the various sets of ramps convert the upward force of the annular piston sleeve 15 into an outward radial force causing the expansion elements 13, 14 to expand radially outwardly. This forces the slips 13 into forceful contact with the casing C to hold the packer assembly 10 in place. This also forces the elastomeric sealing elements 14 into forceful contact with the casing C to create a fluid tight seal. The expansion mechanism and setting mechanism can be locked in place by a releasable capture mechanism, such as the snap ring 21 between the annular piston 16 and the annular piston cover 17. It can be seen that this leaves the annular piston sleeve 15, the annular piston 16, and the annular piston cover 17 in compression, and the body mandrel 12 in tension. Conversely, the releasable capture mechanism could lock the setting mechanism in place relative to the body mandrel 12.

FIG. 3 shows the cutting tool 20 after it has been lowered into place within the packer assembly 10, precisely positioning the cutting blade 22 at a selected longitudinal point on the lower portion of the body mandrel 12 below the expansion mechanism, preferably below the annular piston 16. The selected or target cut location is chosen to insure that the body mandrel 12 can be severed at a location which will allow the expansion mechanism to be released, without damaging other elements of the packer assembly 10. The cutter body 24 has been rotated to rotate the cutting blade 22 and sever the body mandrel 12 at the selected point. Other types of cutting tools and cutting elements, such as a chemical cutter, torch, or laser, could also be used in place of the cutting blade 22. The cutting element is designed to precisely penetrate only the body mandrel 12, without further penetrating other elements of the packer assembly 10, such as the annular piston cover 17.

Once the body mandrel 12 is severed, the lower production tube PT and the annular piston cover 17 are free to fall, if not supported from below, until a shoulder on the setting mechanism abuts a stop member, such as a lock ring 23, on the body mandrel 12. Where the releasable capture mechanism, such as the snap ring 21, locks the annular piston 16 to the annular piston cover 17, this falling of the annular piston cover 17 will normally be forceful enough to pull the annular piston 16 and the remainder of the setting mechanism downwardly, by abutment of the shoulders shown on the annular piston 16 and the annular piston cover 17, to retract the expansion elements 13, 14. This frees the packer assembly 10 to be pulled out of the well, along with the production tube PT, by means of the abutment of shoulders on the annular piston 16 and the annular piston sleeve 15 with a shoulder on the annular piston cover 17 and a lock ring 23 on the body mandrel 12, respectively. Where the releasable capture mechanism locks the annular piston 16 to the body mandrel 12, rather than to the annular piston cover 17 as with the snap ring 21, this falling of the annular piston cover 17 may not be forceful enough to pull the annular piston 16 and the remainder of the setting mechanism free from the releasable capture mechanism, or to retract the expansion elements 13, 14. In this situation, the anchoring device or packer assembly 10 can be pulled upwardly to release the capture mechanism. Similarly, if the lower production tube PT is supported below, the packer assembly 10 can be pulled upwardly, thereby releasing the expansion elements.

Figure 4:
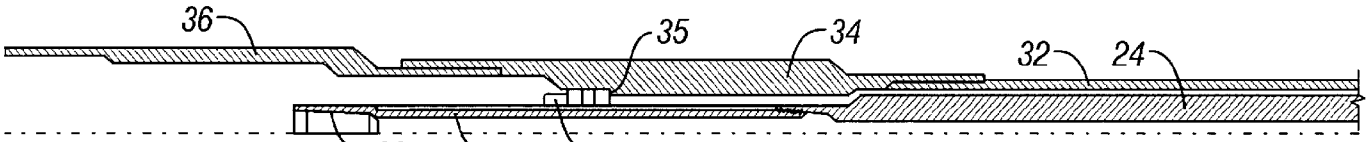
FIG. 4 is a longitudinal section view of a cutter locator profile in a landing sub on the production tubing, and a cutter locator element on a wireline-conveyed or coil-tubing-conveyed cutting tool, according to the present invention.

FIG. 4 shows the upper portion of a first embodiment of the present invention, where the upper end of the packer assembly 10 is left attached to the upper production tubing PT. An extension tube 32 can be attached to the upper end of the packer assembly 10, such as by threaded connectors (not shown). A landing sub 34 can be attached to the upper end of the extension tube 32. A cutter locator profile such as an internal shoulder 35 can be provided on the internal surface of the landing sub 34, protruding into the bore of the upper production tubing PT. A nipple 36 or other connector can be attached above the landing sub 34 to connect the landing sub 34 and the remainder of the packer assembly 10 to the production tube PT thereabove.

The upper end of the cutting tool body 24 is attached to a cutter locator element, such as a collar 28 on an externally threaded sub 26. The collar 28 can be attached to the outer surface of the sub 26 by being threaded thereon and held in place by a set screw. The upper end of the sub 26 can have a suitable connector 29 for a wireline or for coil tubing, as desired.

The cutter locator shoulder 35 is located a first distance from the desired cut point on the body mandrel 12, with this first distance being largely dependent upon the length of the extension tube 32. The cutter locator collar 28 is located a second distance from the cutting element 22 on the cutting tool 20, with this second distance being largely dependent upon the length of the cutting tool 20. The lengths of these tubular elements are selected to insure that the second distance is substantially the same as the first distance, thereby insuring that the cutting element severs the body mandrel 12 essentially at the desired cut point. Precise adjustment of the second distance can be achieved by threading the collar 28 either up or down on the sub 26.

The particular anchoring device being retrieved may have either an appreciable length, or a very limited length, over which the desired cut point may be located, while still achieving the release of the expansion mechanism. The important thing is for the selected cut point to sever the body mandrel, or other structural member, at a location which then permits the other members of the anchoring device to separate longitudinally, to an extent which releases the expansion mechanism.

Figure 5:
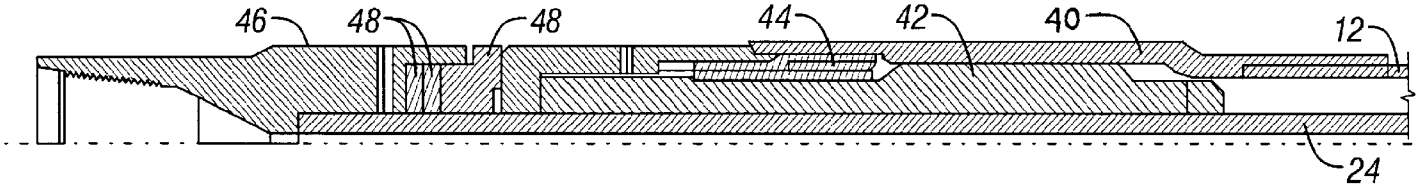
FIG. 5 is a longitudinal section view of a cutter locator profile in the upper end of the packer, and a cutter locator element on a workstring-conveyed cutting tool, according to the present invention.

FIG. 5 shows the upper portion of a second embodiment of the present invention, where the upper end of the packer assembly 10 is disconnected from the upper production tubing PT, and the upper production tubing PT is removed from the well. A suitable connector 40 is provided on the upper end of the packer body mandrel 12. This connector can be threaded. The upper end of the cutter tool body 24 has attached thereto a latch body 42, a latch 44, and a suitable workstring connector 46. The latch 44 can be a segmented slip assembly designed to latch into a thread on the upper end of the connector 40.

Where rotation of the cutting tool 20 is required, the cutter body 24 can be rotatable in the latch body 42, and a bearing assembly 48 can also be provided, allowing the workstring connector 46 and the cutter tool body 24 to rotate relative to the packer body mandrel 12 and the connector 40. Here again, other suitable connectors can also be used on the upper end of the cutting tool 20, without departing from the spirit of the invention.

Important features are that the connectors used in this embodiment accurately locate the cutting element 22 longitudinally, to cut the body mandrel 12 in the target longitudinal location, and that the connectors latch together. Further, where a rotating cutting element is used, the connectors must allow rotation of the cutting tool 20 relative to the body mandrel 12. After this workstring conveyed tool is used to sever the body mandrel 12, the latch 44 remains engaged in the upper packer connector 40, to allow the workstring to pull upwardly on the packer body 12 and release the expansion mechanism. Further, the latch 44 remains engaged to pull the packer assembly 10 out of the hole.

Figure 6:
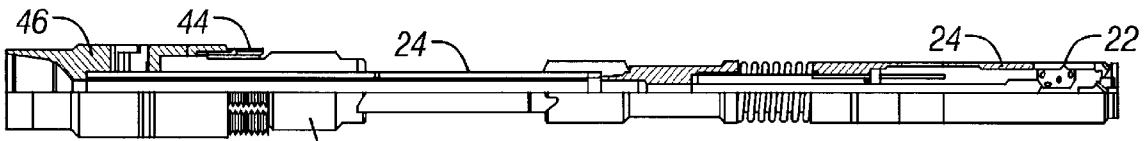
FIG. 6 is a longitudinal partial section view of a workstring-conveyed cutting tool according to the present invention.

FIG. 6 shows a more complete example of one type of workstring-conveyed cutting tool that can be used in the second embodiment of the invention where the production tubing above the packer assembly 10 is removed, and where the workstring is used to both release and retrieve the packer assembly 10. The cutter blade 22 is selectively extendable to protrude through a window in the cutter tool body 24. The latch body 42 can include two engageable clutch elements slidably mounted on the cutter body 24, thereby allowing unthreading of the latch 44 from the threads in the upper packer assembly connector 40, if necessary. Rotatable cutters similar to the lower portion of this cutting tool can also be lowered on coil tubing, and driven by a downhole motor, to sever the body mandrel 12, in the first embodiment of the invention where the packer assembly 10 is left attached to the production tubing.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A method for removing an anchor device from a well, comprising:

providing an anchor device in a well bore, said anchor device having a cutter locator profile, a body mandrel, a radial expansion mechanism on said body mandrel, a setting mechanism, a production tube connected to a lower portion of said body mandrel, and upper and lower travel limiting means fixedly mounted on upper and lower portions, respectively, of said body mandrel;

providing a cutting tool, said cutting tool having a cutting element and a cutter locator element;

moving said setting mechanism in a first longitudinal direction relative to said expansion mechanism, thereby exerting an outward radial force on said expansion mechanism to radially expand and set said expansion mechanism, thereby holding said body mandrel in place in the well bore;

lowering said cutting tool until said cutter locator element of said cutting tool lands in said cutter locator profile of said anchor device, thereby positioning said cutting element at a selected longitudinal location on said body mandrel between said upper travel limiting means and said production tube connection;

activating said cutting element to sever said body mandrel between said upper travel limiting means and said production tube connection, thereby allowing said setting mechanism to move in a second longitudinal direction relative to said expansion mechanism to relieve said outward radial force on said expansion mechanism; and longitudinally retaining said production tube to said upper portion of said body mandrel by contact of said setting mechanism with said upper and lower travel limiting means on said body mandrel.

2. The method recited in claim 1, wherein at least one of said upper and lower travel limiting means comprises a lock ring fixedly mounted on said body mandrel adjacent said expansion mechanism, said method further comprising retaining said production tube to said upper portion of said body mandrel by abutment of a shoulder on said setting mechanism with said lock ring.

3. The method recited in claim 1, wherein at least one of said upper and lower travel limiting means comprises a shoulder fixed relative to said body mandrel, said method further comprising retaining said production tube to said upper portion of said body mandrel by abutment of a shoulder on said setting mechanism with said shoulder fixed relative to said body mandrel.

4. The method recited in claim 1, wherein said setting mechanism comprises a longitudinally movable piston, said method further comprising:

applying hydraulic pressure to move said piston longitudinally to apply longitudinal force to said expansion mechanism; and converting said longitudinal force to said outward radial force on said expansion mechanism.

5. The method recited in claim 4, wherein:

said piston is mounted within a lower sub connected to said lower portion of said body mandrel; and said longitudinal movement of said piston is performed at least partially within said lower sub.

6. The method recited in claim 4, further comprising:

moving said piston longitudinally upwardly to apply upward force; and activating said cutting element to sever said body mandrel below said expansion mechanism, thereby relieving said outward radial force on said expansion mechanism.

7. The method recited in claim 1, wherein:

said cutter locator profile comprises an internal shoulder within said production tube; and said cutter locator element comprises an external shoulder on said cutting tool;

said method further comprising:

pulling upwardly on said production tube, after severing said body mandrel with said cutting element, thereby applying a tensile force to retract said expansion mechanism; and pulling said anchor device out of said well with said production tube.

8. The method recited in claim 7, further comprising suspending said cutting tool from a wireline.

9. The method recited in claim 7, further comprising suspending said cutting tool from coil tubing.

10. The method recited in claim 9, wherein said cutting element comprises a cutting blade, said method further comprising rotating said cutting blade to sever said body mandrel.

11. The method recited in claim 1, wherein:

said cutter locator profile comprises a first connector above said anchor device; and said cutter locator element comprises a second connector on said cutting tool, said second connector being adapted to connect to said first connector;

said method further comprising:

removing said production tube from said first connector on said anchor device;

suspending said cutting tool from a tubular workstring;

connecting said second connector to said first connector when said second connector lands in said first connector;

pulling upwardly on said tubular workstring, after severing said body mandrel with said cutting element, thereby applying a tensile force to retract said expansion mechanism; and pulling said anchor device out of said well with said tubular workstring.

12. The method recited in claim 11, wherein said cutting element comprises a cutting blade, said method further comprising rotating said cutting blade to sever said body mandrel.

13. The method recited in claim 12, further comprising rotating said cutting blade by rotating said tubular workstring.

14. An apparatus for removing an anchor device from a well bore, said apparatus comprising:

a body mandrel on said anchor device;

an expansion mechanism on said anchor device;

a setting mechanism on said anchor device, said setting mechanism being adapted to exert a radial force on said expansion mechanism to expand and set said expansion mechanism;

a capture mechanism adapted to releasably capture said setting mechanism to said body mandrel;

upper and lower travel limiters fixedly mounted on upper and lower portions, respectively, of said body mandrel, said travel limiters being adapted to abut portions of said setting mechanism to limit longitudinal travel of said upper portion of said body mandrel relative to said lower portion of said body mandrel;

a cutter locator profile mountable to a production tube, said cutter locator profile being mountable a first distance from a selected cut location on said body mandrel, said cut location being between said upper travel limiter and a lower end of said body mandrel;

a cutting tool having a cutting element; and a cutter locator element mountable to said cutting tool, said cutter locator element being adapted to land in said cutter locator profile, said cutter locator element being spaced from said cutting element by a second distance;

wherein said second distance is substantially the same as said first distance.

15. The apparatus recited in claim 14, wherein at least one of said upper and lower travel limiters comprises a lock ring fixedly mounted on said body mandrel adjacent said expansion mechanism, said setting mechanism being adapted to retain said lower portion of said body mandrel to said upper portion of said body mandrel by abutment of a shoulder on said setting mechanism with said lock ring.

16. The apparatus recited in claim 14, wherein at least one of said upper and lower travel limiters comprises a shoulder fixed relative to said body mandrel, said setting mechanism being adapted to retain said lower portion of said body mandrel to said upper portion of said body mandrel by abutment of a shoulder on said setting mechanism with said shoulder fixed relative to said body mandrel.

17. The apparatus recited in claim 14, wherein:

said setting mechanism comprises:

a longitudinally movable piston; and a source of hydraulic pressure, said pressure source being adapted to apply hydraulic pressure between said piston and said lower portion of said body mandrel;

said piston is adapted to apply upward force;

said setting mechanism is adapted to convert said upward force to said outward radial force on said expansion mechanism; and said second distance is selected to position said cutting element to sever said body mandrel below said piston, thereby relieving said outward radial force on said expansion mechanism.

18. The apparatus recited in claim 17, wherein:

said piston is mounted within a lower sub connected to said lower portion of said body mandrel; and said piston is at least partially longitudinally movable within said lower sub.

19. The apparatus recited in claim 14, wherein:

said cutter locator profile comprises an internal shoulder within said production tube; and said cutter locator element comprises an external shoulder on said cutting tool.

20. The apparatus recited in claim 19, further comprising a wireline head on said cutting tool adapted for suspending said cutting tool from a wireline.

21. The apparatus recited in claim 19, further comprising a coil tubing connector on said cutting tool adapted for suspending said cutting tool from coil tubing.

22. The apparatus recited in claim 21, wherein said cutting element comprises a cutting blade, said cutting blade being adapted to rotate to sever said body mandrel.

23. The apparatus recited in claim 14, wherein:

said cutter locator profile comprises a first connector on an upper end of said anchor device; and said cutter locator element comprises a second connector on said cutting tool, said second connector being adapted to connect to said first connector;

further comprising:

a tubular connector on said cutting tool adapted for suspending said cutting tool from a tubular workstring; and a lifting mechanism adapted to pull upwardly on said tubular workstring, to pull said anchor device out of said well with said tubular workstring.

24. The apparatus recited in claim 23, wherein said cutting element comprises a cutting blade, said cutting blade being adapted to rotate to sever said body mandrel.

25. The apparatus recited in claim 24, further comprising a rotating mechanism adapted to rotate said cutting blade by rotating said tubular workstring.

26. An apparatus for removing an anchor device from a well bore, said apparatus comprising:

a body mandrel within said anchor device;

a radial expansion mechanism on said body mandrel;

a longitudinally slidable setting mechanism on said body mandrel;

upper and lower travel limiters fixedly mounted on upper and lower portions, respectively, of said body mandrel;

means for applying hydraulic pressure to exert compressive stress on said setting mechanism and to exert tensile stress between said upper and lower portions of said body mandrel, to thereby exert a radial force on said expansion mechanism to expand and set said expansion mechanism;

a cutter adapted to sever said body mandrel from within, between said upper and lower portions thereof;

said setting mechanism being adapted to abut an upper face of said upper travel limiter, and said setting mechanism being adapted to abut a lower face of said lower travel limiter, to thereby retain said upper portion of said body mandrel to said lower portion thereof, after severance of said body mandrel.

27. The apparatus recited in claim 26, further comprising:

a downwardly facing shoulder on said setting mechanism to abut said upper face of said upper travel limiter; and an upwardly facing shoulder on said setting mechanism to abut said lower face of said lower travel limiter.

* * * * *